US007810794B2

(12) United States Patent
Chen

(10) Patent No.: US 7,810,794 B2
(45) Date of Patent: Oct. 12, 2010

(54) BREAK RESISTANT JOINT

(76) Inventor: Yung Chen, 3 Larkspur La., Clarendon Hills, IL (US) 60514

( * ) Notice: Subject to any disclaimer, the term of this patent is extended or adjusted under 35 U.S.C. 154(b) by 867 days.

(21) Appl. No.: 11/728,984

(22) Filed: Mar. 28, 2007

(65) Prior Publication Data

US 2008/0237899 A1 Oct. 2, 2008

(51) Int. Cl.
*B01F 3/04* (2006.01)

(52) U.S. Cl. ..... 261/28; 261/89; 239/289

(58) Field of Classification Search ..... 261/28, 261/89, 90, DIG. 3, DIG. 43; 239/289, 290
See application file for complete search history.

(56) References Cited

U.S. PATENT DOCUMENTS 5,620,633 A * 4/1997 Junkel et al. ..... 261/28
5,843,344 A * 12/1998 Junkel et al. ..... 261/28
6,398,132 B1 * 6/2002 Junkel et al. ..... 239/289
6,827,290 B2 * 12/2004 Zimmerman ..... 239/215

* cited by examiner

*Primary Examiner*—Scott Bushey
(74) *Attorney, Agent, or Firm*—Basil E. Demeur; Alan Samlan; David J. Hurley

(57) ABSTRACT

There is disclosed a portable misting fan formed by upper and lower body portions which are joined together along a joint. The joint is improved by providing the lower body portion with a non-circular neck portion along its top end, and wherein the upper body portion includes two halves which terminate in lower body collar sections, intended to be joined together in overlying relationship relative to the neck portion. A rail and groove system is employed as between the upper first and second body portions, and the neck portion, so that the rails will slidingly engage the grooves in the neck portion rendering the joint resistant to rotation. The neck portion includes an aperture into which a sleeve is press fitted, the sleeve includes upper and lower lips, and the lower body collar sections include inwardly extending flanges which overlie and engage the upper and lower lips formed in the sleeve, thereby brace and secure the pump assembly within the device.

18 Claims, 8 Drawing Sheets

BREAK RESISTANT JOINT

I. FIELD OF THE INVENTION

The present invention relates to misting fan devices, generally of the type formed by an upper body portion which includes a motorized fan and a pump assembly having a misting nozzle associated therewith, and a lower body portion which basically accommodates a fluid reservoir, and a fill port for filling the fluid reservoir with a fluid. According to the present invention, a more secure and break resistant joint as between the upper and lower body portions is presented.

II. BACKGROUND OF THE INVENTION

Portable misting fans have become quite popular over the last several years. These devices generally tend to be formed by an upper body portion which includes a fan device which is motorized, and usually powered by one or more batteries contained in a battery compartment, and electrically connected to a motor which operates the fan. The upper body portion is further provided with a pump assembly which terminates in a misting nozzle, wherein the mist is directed into the air stream created by the fan. The lower body portion generally accommodates a fluid reservoir which is usually filled with water or a mixture of ice and water, and also includes a fill port to permit the user to easily fill the fluid reservoir with water. The upper and lower body portions are affixed together incident to the assembly thereof, and this is usually accomplished by having the lower body portion in the configuration of a bottle with a screw-threaded neck, and the upper body portion includes a cap which has threads, and screw-threads onto the bottle. In this manner, the upper and lower body portions of the fan device are inner-connected. In the original variation of the device, the method of filling the fluid reservoir was to unscrew the upper body portion from the lower body portion, and simply fill the bottle with fluid. The bottle would then be screwed back onto the upper body portion to form the entire fan device. The bottle was designed to have a diametric dimension rendering the same to be held by the hand of the user in relatively easy fashion. However, one of the drawbacks of that variation of a misting fan device was that the neck of the bottle was usually a typical bottle neck, and therefore not sized sufficiently large to allow the operator or user to insert ice cubes therein. Therefore, in order to have cooled fluid, it was necessary to obtain the water from a cooled source.

That objection has been overcome by providing a separate fill port in the lower body portion of the device, the fill port having a diametric dimension sufficiently large enough so that ice cubes may be inserted into the fluid reservoir. The fill port could either be located on the side wall of the device, in which case, the fill port would be covered by a fill cap which would be appropriately gasketed so that a fluid tight seal is achieved. Alternatively, the fill port can be on the very bottom of the device, such that fill cap which actually forms the bottom of the device and is positioned over the bottom opening of the device in fluid tight arrangement.

However, whatever construction is employed, generally, in order to manufacture a portable misting fan device, it is necessary to join together the upper body portion to the lower body portion through some means of engagement. As was indicated above, while this has generally been done with a threaded neck with a screw cap, it has been found that such an arrangement represents an inherent weakness in the device. It is well known that these devices are generally used in the out of doors, or in connection with sports activities. Hence, the portable fan devices are prone to being dropped or otherwise handled in a rough manner and where the device incorporates a weakness, the device is prone to breakage. For example, the typical portable misting fan device of the type which is formed by means of a bottle having a neck with threads and accommodates the upper body portion thereon by screw-threading a cap thereon, the joint between the upper and lower body portions is rather weak and very prone to breakage when dropped. Once the device is dropped and breakage occurs, the device is no longer useful and must be discarded.

Another problem arises from the fact that current devices may also include a shroud which surrounds the impeller blades of the fan. The shroud functions to protect the fan blades from damage, and also protects the user from the movement of the fan blades. In order to create a device that has a shroud surrounding the impeller blades, the devices are generally made with two pieces, including front portion of the shroud, and a rear portion of the shroud, the front and rear then being joined together. It is therefore apparent that where the device includes a shroud, there is even a further joint which would be prone to breakage upon dropping the device.

Various attempts have been made in finding different methods for assembling the upper and lower body portions together so that the joint between the two portions is more break resistant and secure. It is apparent that the more break resistant the joint, the longer life the product has for the user thereof.

Prior U.S. Pat. No. 6,398,132 shows various means of creating a joint between the upper and lower body portions. Various of the embodiments disclosed in the aforementioned patent show the use of adhesives to secure the head unit or the upper body portion to the lower body portion or the chamber, as illustrated in FIG. 9A of the drawings. A further modification describes the use of ultrasonic welds which are used to secure the upper head unit or upper body portion to the bottle portion or fluid reservoir. The patent further illustrates a method of heat staking the joint which would bond the neck of the bottle to the collar of the upper body portion. Further modifications of devices illustrated in the aforementioned patent show the application of two half units which are used to surround the neck of the bottle, after which the same are adhesively bonded and screwed together. These variations particularly relate to a misting fan device which is formed of two half sections which are jointed together in order to complete the assembly.

The present invention seeks to provide an improved misting fan device which is assembled in a manner which renders the joint between the upper and lower body portions to be more break resistant and therefore more resistant to damage when dropped. It has been determined that by changing the configuration of the neck portion, and the configuration of the collar of the upper body portion which attaches to the neck portion, a more secure joint is achieved.

III. OBJECTS AND ADVANTAGES

It is therefore the principal object of the present invention to provide an improved portable misting fan device of the type generally formed by an upper body section and a lower body section which are joined together in order to form a complete device. The object of the invention is provide a more secure joint as between the two sections in order to render the device more break resistant.

In furtherance of the aforegoing object, an object of the present invention is to provide a portable misting fan device of the type generally described, wherein the lower body portion is formed in an upwardly contoured configuration which terminates in an upper neck portion having a non-circular configuration with a relatively flat top wall. The neck portion is provided with at least one groove running along the side wall of the neck portion. The upper body portion is formed from a first half body portion and second half body portion, both of which terminate in a first and second collar bodies respectively. The first and second collar bodies are contoured and configured to overlie and capture the neck of the lower body portion therebetween. Each of the first and second collar bodies is provided with rails which are sized and positioned such that the rails engage within the groove of the neck portion when the first and second half body portions are assembled onto the neck. Hence, the combination of the non-circular configuration of the neck portion as well as the rail and groove structure prevents the upper body portion from rotating in any manner relative to the lower body portion, and secures the joint between the two parts in a more break resistant manner.

In conjunction with the foregoing object, a further object of the present invention is to provide an improved portable misting fan device of the type described, wherein each of the first and second collar bodies forming the upper body portion are provided with a pair of rails, and the neck portion of the lower body portion is provided with opposed grooves on either of the opposed side walls of the neck, such that when the first and second half body portions are assembled onto the neck portion, the respective rails will slidingly engage within the grooves of the neck portion, when assembled thereon. Lock means may then be employed for lockingly engaging the two half sections together once assembled on the neck of the lower body portion.

A further object of the present invention is to further improve upon the device, by providing a sleeve which is press fitted into an aperture formed in the top wall of the neck portion, the sleeve accommodating the pump assembly therethrough. The sleeve has a lower lip which is formed by a flange which extends outwardly from the sleeve for a short distance. Each of the first and second collar bodies is provided with a flange formed along the interior side wall thereof and extending outwardly a short distance, the flange being sized and positioned such that upon assembly of the first and second half portions onto the neck portion, the flanges will overlie the lower lip of the sleeve. In this manner, the flanges provide additional support for the pump assembly rendering that portion of the device more break resistant.

A further object of the present invention, in view of the foregoing object, is to provide a sleeve which has an upper lip, and a lower lip and each of the first and second collar bodies is provided with a pair of flanges which are sized and positioned such that upon assembly of the first and second half body portions together, the respective flanges will overlie and seat against the respective upper and lower lips of the sleeve when assembled thereon thereby to provide additional support for the pump assembly.

Further objects and advantages will best be understood by reference to the accompanying drawings taken in conjunction with the specification as set forth hereinafter.

IV. SUMMARY OF THE INVENTION

In summary, the present invention provides a portable water misting fan device which is formed by an upper body portion and a lower body portion which are joined together to form a complete fan device. The invention is directed to the construction of the joint between the upper and lower body portions and results in a joint which is more break resistant than prior art device. The joint is created by a re-engineering of the elements forming the joint.

The lower body portion forms the fluid reservoir and incorporates a fill port for filling the fluid reservoir in a known manner. The lower body portion terminates at its top end in a non circular neck portion which is surrounded at its lower end by a support ledge formed in the lower body portion. The neck portion, in the preferred embodiment, includes a pair of opposed grooves formed in opposed side walls of the neck portion. The top wall of the neck portion is provided with an aperture which accommodates a sleeve fitted therein. The sleeve provides a fitting for the pump assembly to establish fluid communication between the fluid reservoir and the fluid misting assembly in the upper body portion.

The upper body portion is formed by a front half body portion and a rear half body portion which are joined together around the neck portion of the lower body portion. The half body portions may alternately be right and left half body portions installed over the neck portion to form the upper body portion. The front and rear half body portions accommodate the fan assembly and the fluid misting pump assembly. Each of the front and rear half body portions terminate at the lower end thereof in a first or front collar body and a second or rear collar body. When assembled, the front and rear collar bodies rest on the support ledge of the lower body portion.

The front and rear collar bodies are each provided with rails formed along the interior walls thereof, and are positioned so as to engage with the grooves formed on the opposed side walls of the neck portion. The rails are centrally cored and are threaded, and the rear half body portion is provided with access openings to accommodate screws there through such that the front and rear body halves may be lockingly engaged together once installed on the neck portion. For some applications, sonic welding, heat staking or snap fit joints might be more appropriate and provide comparable durability.

Break resistance is further enhanced by providing enhanced security for the pump assembly. This is accomplished by providing a sleeve fitted within the neck aperture with a lower lip and an upper lip formed thereon. The front and rear half body portions are provided with a flange formed along the interior wall thereof which is positioned to overlie the lower lip when the front and rear half body portions are installed on the neck portion and locked together. Further, each of the front and rear half body portions is provided with an upper securement flange which is positioned to overlie the upper lip when the halves are in the installed position. Finally, one or both of the front and rear half body portions is provided with a bracing flange which is positioned to engage and brace against the sleeve when the front and rear half body portions are in the installed position. Hence, when the front and rear half body portions are installed on the neck portion, the respective flanges will overlie the respective lips to brace the pump assembly and resist damage to same.

V. BRIEF DESCRIPTION OF DRAWINGS

VI. DETAILED DESCRIPTION OF DRAWINGS

Figure 1:
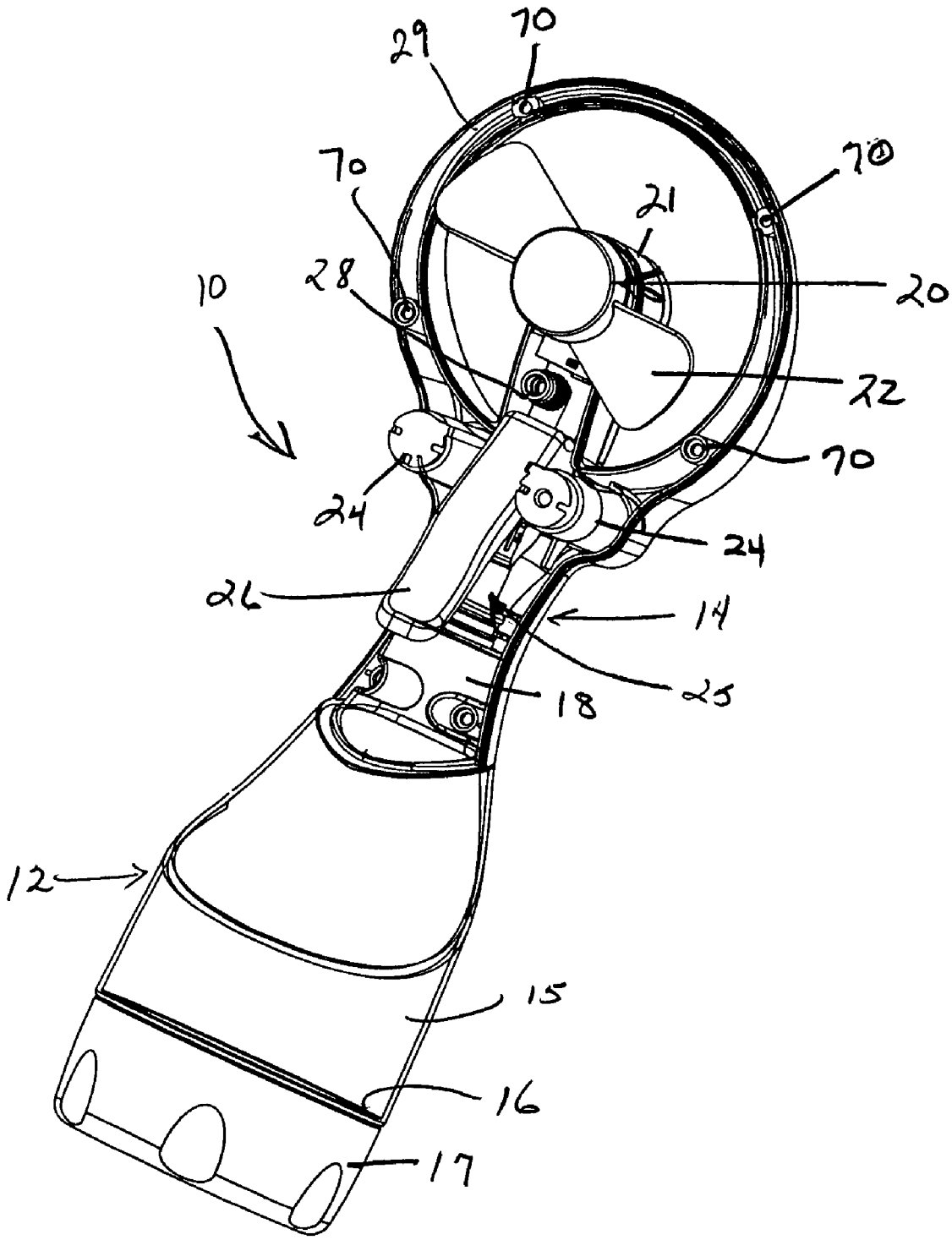
FIG. 1 is a front perspective view of the misting fan device showing the upper body portion having the rear half body portion in place and first half body portion removed.
Figure 2:
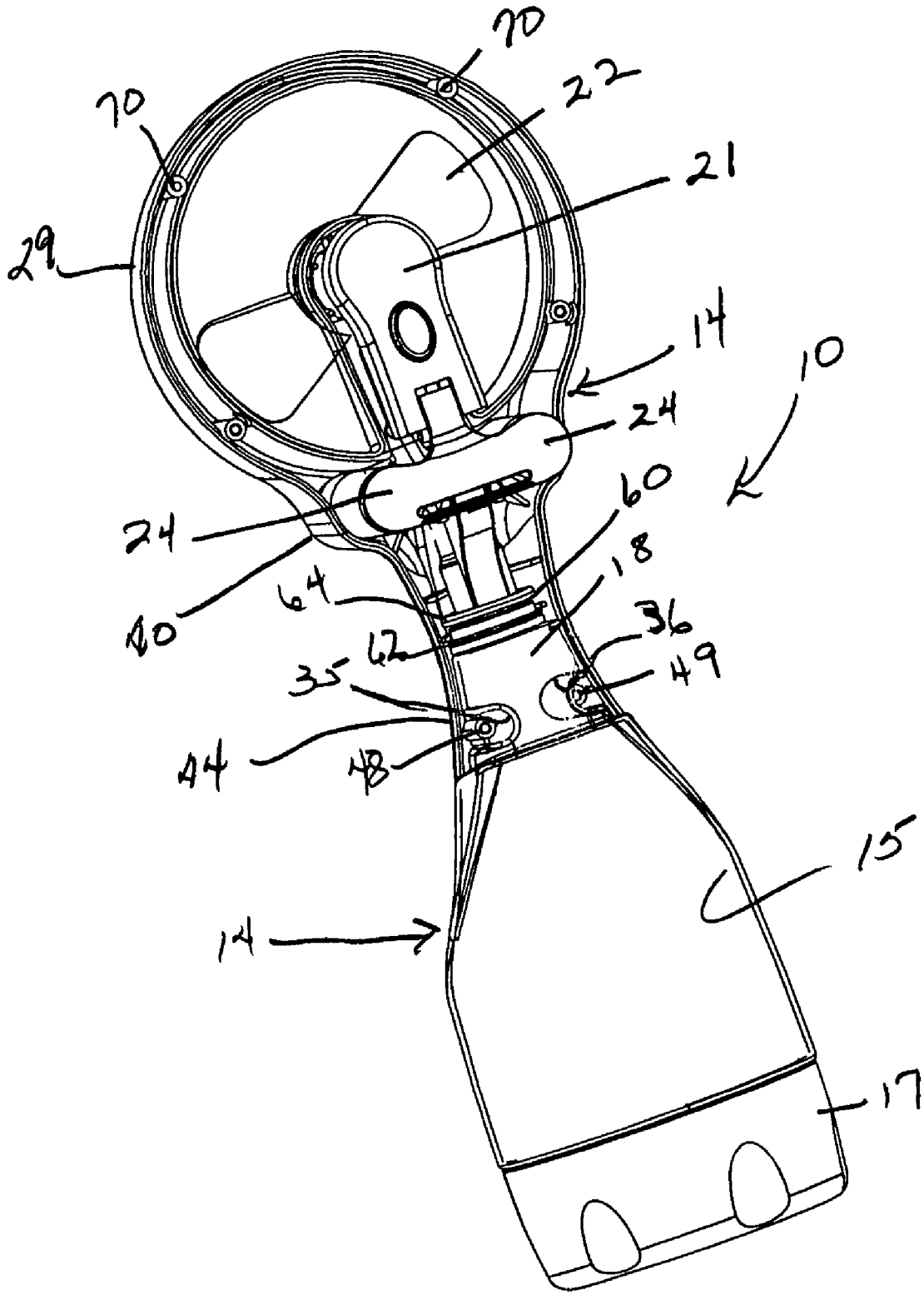
FIG. 2 is a rear perspective view, showing the front half body portion in place and the rear half body portion removed and the positioning of the rails and the grooves of the neck portion and the access openings positioned therein.

As shown in FIG. 1, the fan device 10 is generally formed by a lower body portion 12, and an upper body portion 14. The lower body portion 12 forms the fluid reservoir 15 which, in this embodiment, is provided with an enlarged fill port 16, which is enclosed by means of a cap 17. It will be appreciated in the embodiment as disclosed, that enlarged fill port 16 permits the operator to fill the fluid reservoir 15 with water, and to further permit the insertion of ice cubes through the enlarged fill port 16. The cap 17 is appropriately gasketed, as is well known in the art, so that a fluid tight seal is created as between the cap 17 and fill port 16. The upper part of the lower body section 12 terminates in a neck portion 18 which will be described in greater detail hereinafter.

The upper body portion 14 supports the fan assembly 20 which is driven by a motor contained within motor enclosure 21 which in turn drives the impeller blades 22. The upper body portion 14 includes battery compartments 24 which accommodate appropriate batteries for operating the motor in order to activate the fan assembly 20. The upper body portion 14 further includes a pump assembly 25 which, as is well known in the art, includes a piston rod (not shown), driven by a piston trigger 26 which operates to bring fluid to a fluid misting nozzle 28. In the embodiment as illustrated, the upper body portion 14 includes a shroud 29 which encircles the impeller blades 22 and operates to protect the impeller blades 22 from damage, and also to protect the operator from the rotational movement of the impeller blades 22 when activated.

Figure 9:
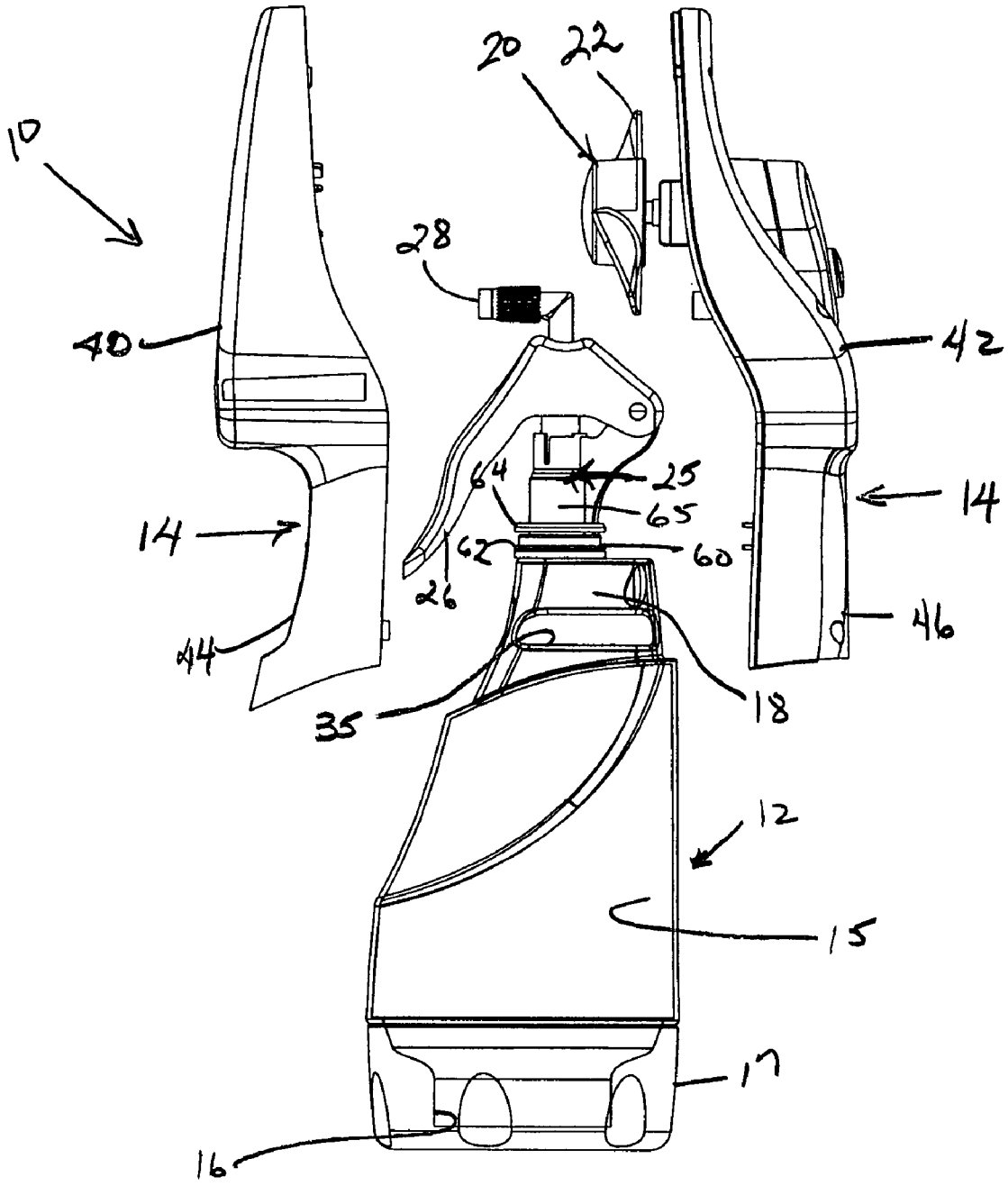
FIG. 9 is a side elevational view showing the lower body portion of the fan device and the front and rear half body portions in blown apart relation prior to installation on the neck portion.

As will be appreciated from a view of FIG. 9 of the drawings, the entire fan device 10 is created by installing the upper body portion 14 onto the lower body portion 12. As has been indicated in the past, typically the joint formed between the two parts is created by means of a threaded neck which is formed on the lower body portion 12, while the upper body portion 14 is usually provided with a threaded cap which screw threadedly mounts onto the neck of the lower body portion 12. The present invention seeks to present an improved joint between the two sections in order to resist breakage thereby increasing the life of the product. The following description is related to the improved joint as between the upper body portion 14 and lower body portion 12.

Figure 6:
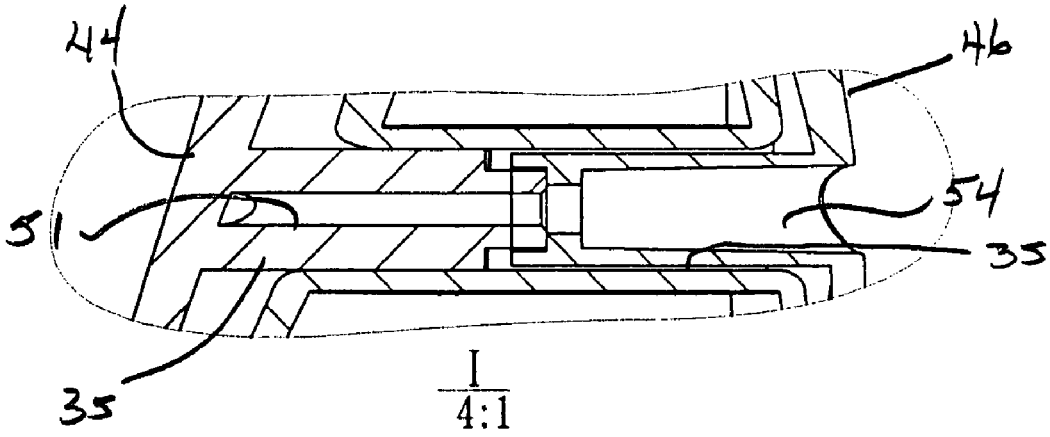
FIG. 6 is a detailed view in cross section taken from FIG. 4 showing the groove and rail system as between the neck portion and the front and rear half body portions and the access openings in the rear half body portion.
Figure 7:
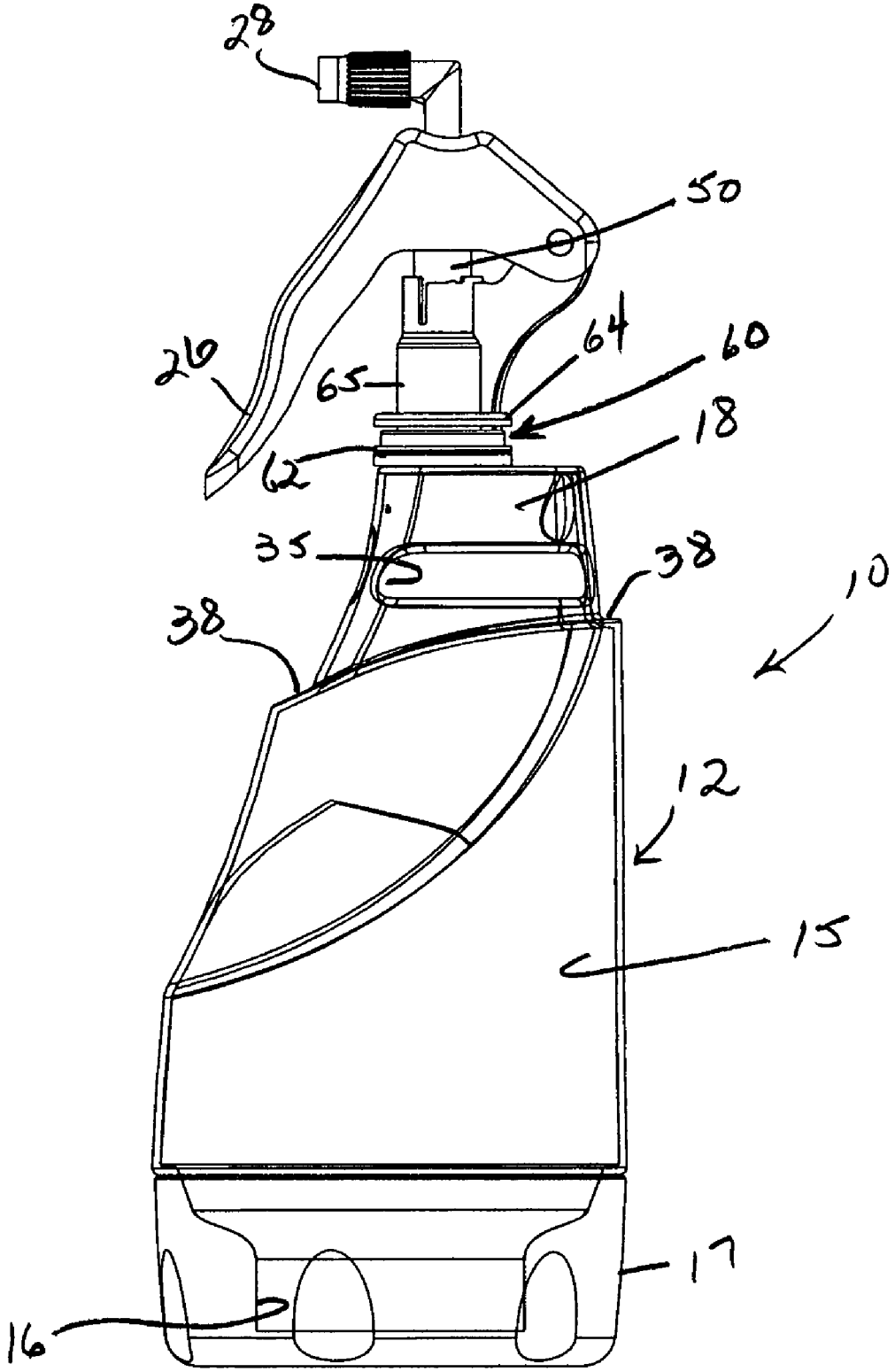
FIG. 7 is a side elevational view of the lower body portion showing the neck portion with support ledge surrounding the neck.
Figure 8:
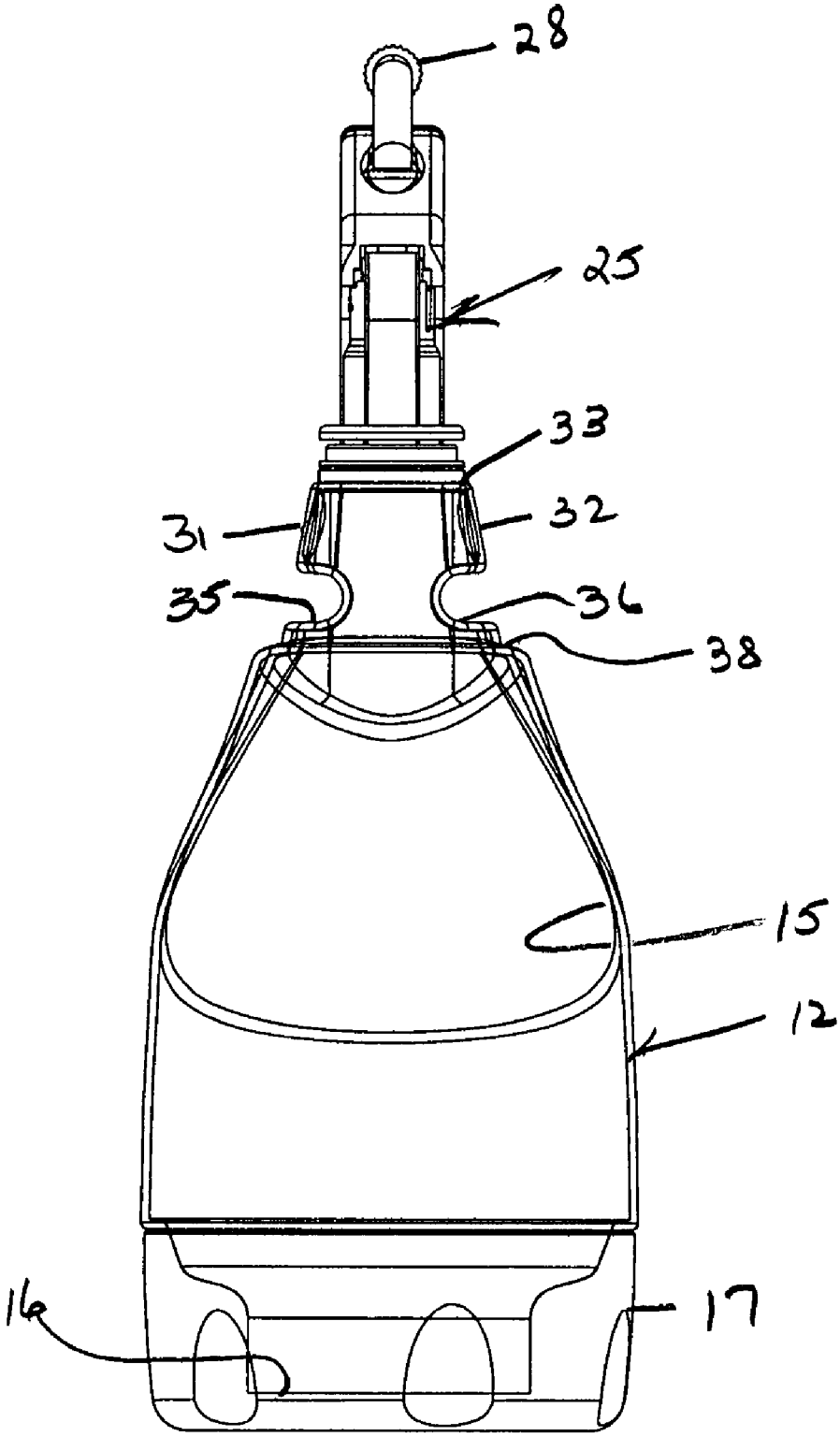
FIG. 8 is a rear elevational view of the lower body portion showing the neck portion thereof and the grooves formed in the opposed side walls thereof.

With reference to FIGS. 2 through 9 of the drawings, as previously indicated, the upper part of the lower body portion 12 terminates in a neck portion 18. The neck portion 18 has a non-circular configuration, and is formed by opposed side walls 31 and 32 respectively, and a substantially flat top wall 33. As illustrated in FIG. 8, the opposed side walls 31 and 32 of the neck portion 18 are provided with opposed grooves 35 and 36 respectively. The grooves 35 and 36 are substantially parallel to one another, and generally run between the front and rear of the device 10. The lower body portion 12 further is provided with a support ledge 38 which surrounds the neck portion 18. The support ledge 38 surrounds the neck portion 18 and provides a surface for supporting the upper body portion 14 as will be more fully described hereinafter.

Figure 3:
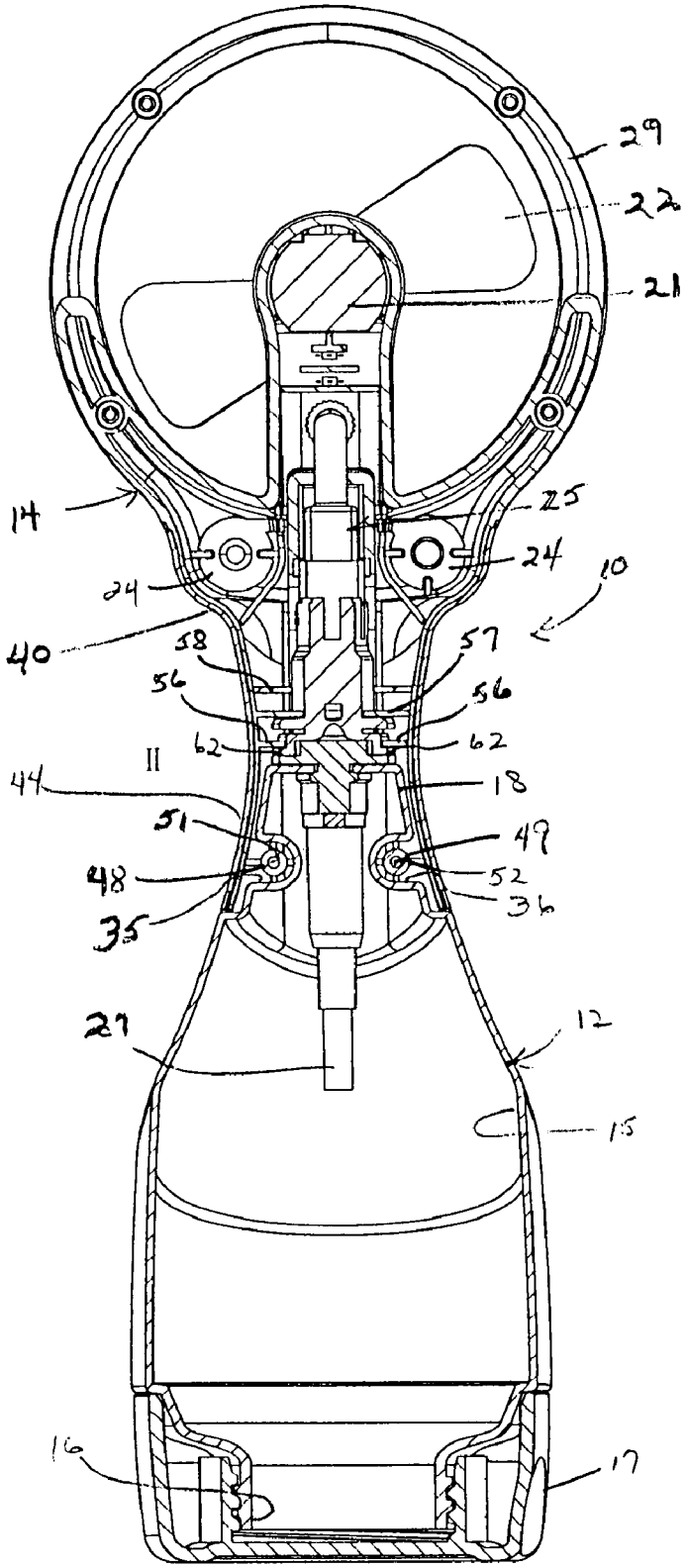
FIG. 3 is a rear elevational view in cross section showing the configuration of the neck portion and the rail and groove system, and further showing the respective lips and flanges as between the sleeve and rear body half portion to form the break resistant joint.

As particularly shown in FIG. 9, the upper body portion 14 is generally formed by a front half body portion 40, and a rear half body portion 42. It will therefore be appreciated that the shroud 29 is actually formed by a front half body portion 40 and rear half body 42, which when installed on the neck portion 18, forms the total upper body portion 14. If desired, the shroud 29 could be formed by left and right half body portions however, for ease of further description, a front and rear half body portions will be described. Each of the front half body portion 40 and rear half body portion 42 terminates at their lower end in a first or front collar body 44 and a rear or second collar body 46. Each of the front and rear half body portions 40 and 42 respectively is provided with a rail 48 and 49 respectively (See FIG. 3). As seen in FIG. 3, the rails 48 and 49 are designed to engage within the respective grooves 35 and 36 when the front and rear half body portions 40 and 42 are installed onto the neck portion 18. Each of the rails 48 and 49 includes a central core 51 and 52 respectively which are provided with appropriate threads therein. In the present embodiment, the rear half body portion 42 is provided with access openings 54 which provides an access port to install appropriate screws for screw-threading the respective rails 48 and 49 together when the front and rear half body portions 40 and 42 are installed onto the neck portion 18. As previously mentioned, other means may be employed to join the parts together including heat staking, sonic welding, snap fit, and pin in socket.

Figure 4:
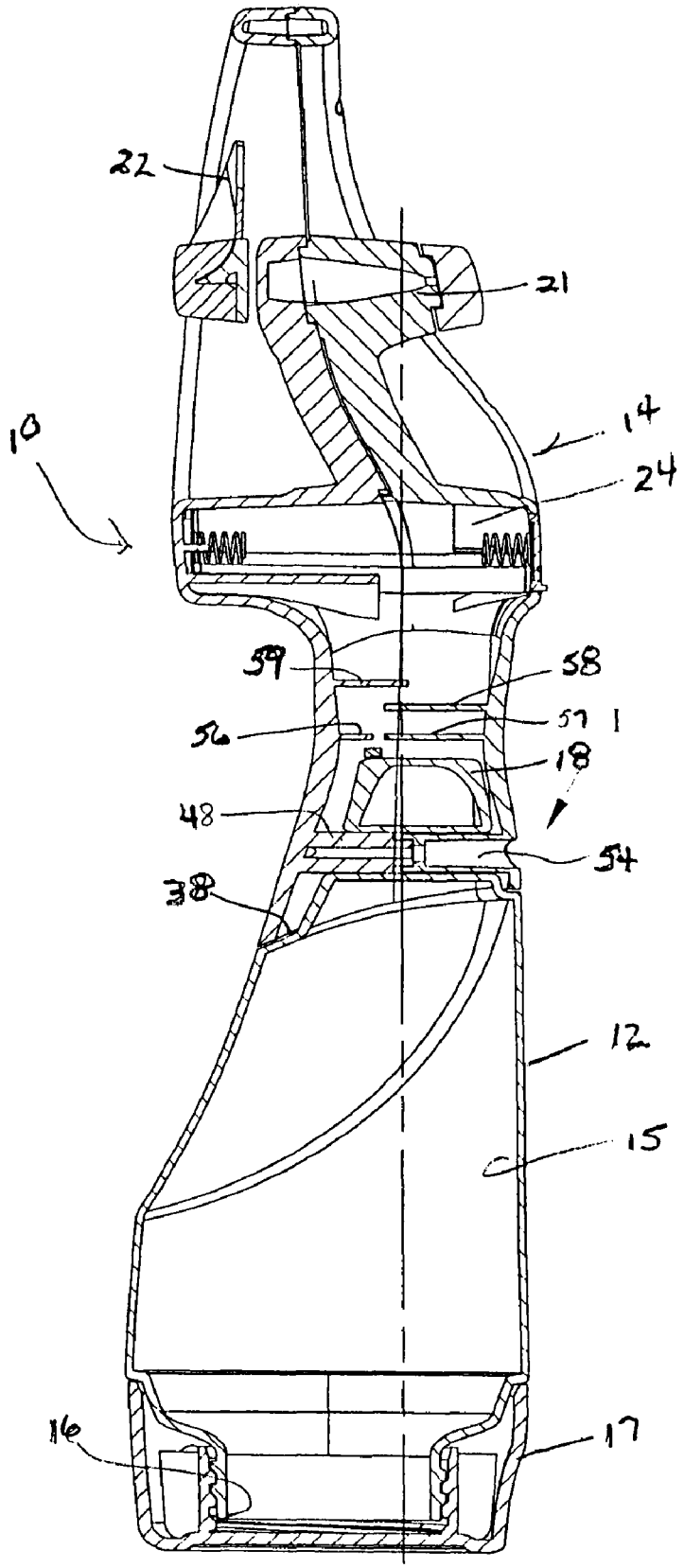
FIG. 4 is a side elevational view in cross section, showing the front and rear half body portions installed on the neck portion and the rail and groove system of the respective parts and the positioning of the flange, securement flange and bracing flange formed on the front and rear half body portions.

Further, and as shown in FIGS. 3 and 4 of the drawings, the front and half body portions 40 and 42 respectively are each provided with flanges 56 and 57, and with a further securement flange 58, and a bracing flange 59.

As shown in FIGS. 7-9 of the drawings, a sleeve 60 is provided which fits within a neck aperture (not shown) formed in the top wall of the neck portion 18. The sleeve 60 is tubular in configuration, and provides access for the pump assembly 25 in order to accommodate fluid communication as between the fluid misting nozzle 28, and the fluid reservoir 15. It will be appreciated that the various components of the pump assembly 25 will fit within the sleeve 60, and will be manipulated by means of the pump trigger 26. The pump assembly 25 operates in a manner well known in the art, such as by actuating the piston trigger 26 repeatedly in order to pump fluid up from the fluid reservoir 15 via the dip tube 27 (FIG. 3), again as is well known in the art.

The sleeve 60 is shown to include a lower lip 62 and an upper lip 64 spaced upwardly from the lower lip 62. The upper part of the sleeve 60 includes a top section 65 which again is tubular in configuration and allows the pump piston 50 to traverse therethrough. As shown in FIGS. 3 and 4 of the drawings, the flanges 56 and 57 will overlie and rest against the lower lip 62 when the upper body front and rear body half portions 40 and 42 are installed on the neck portion 18. Further, the securement flange 58 will rest against the upper lip 64, and the bracing flange 59 will brace against the top section 65 of the sleeve 60. In actual construction, the flanges 56, 57 and 58 are semi-circular in configuration in view of the fact that the first and second collar bodies 44 and 46 are substantially semi-circular in configuration. It will also be appreciated that the lower lip 62 and upper lip 64 are basically circular in configuration since the sleeve 60 has a tubular configuration which is substantially circular. It will therefore be appreciated that when the front half body portion and rear half body portion 40 and 42 respectively come together in their assembled configuration, they will effectively overlie the lower lip and upper lip 62 and 64 respectively. It will also be appreciated that when the screws are inserted through the access openings 54 in order to screw the central cores 51 and 52 together incident to the installation operation, the bracing flange 59 will come to rest and brace against the top section 65 of the sleeve 60.

Figure 5:
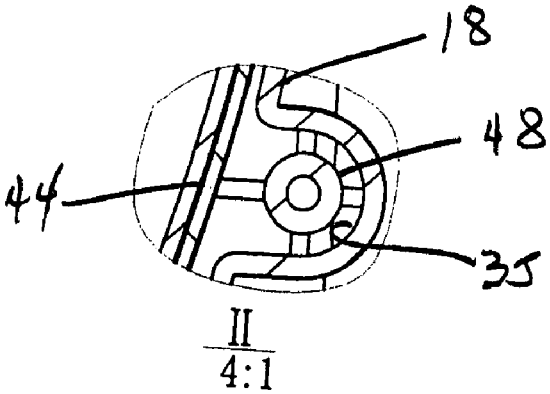
FIG. 5 is a detailed view in cross section taken from FIG. 3 showing the rail and groove system as between the neck portion and the front half body portion.

The fact that the neck portion 18 has a non-circular configuration and basically is formed with opposed side walls which are substantially parallel, and flat top wall, will create a more break resistant joint. As shown in FIGS. 5 and 6, once the rails of the first and second collar bodies 44 and 46 are inserted into the grooves 35 and 36 of the neck portion 18, the assembly will result in a joint which resists the ability to rotate the upper body portion 14 relative to the lower body portion 12. The respective flanges 56, 57 and 58 formed on the interior wall of the front and half body portions 40 and 42 will provide bracing for the pump assembly and hence increase the break resistance of the pump assembly.

It will also be appreciated that in order to further secure the two front and half body portions 40 and 42 together, incident into the assembly thereof, a series of securement apertures 70 may be provided in each of the front and rear half body portions 40 and 42 which allow screws to be inserted therethrough in order to screw-thread the parts together and lock the same together.

It will be appreciated that the construction of the upper body portion 14 and lower body portion 12 when assembled together, will resist rotation because of the configuration of the neck portion 18 being non-circular, and further providing the groove and rail system as between the neck portion 18, and the front and rear half body portions 40 and 42. Breakage of the pump assembly is further resisted by providing a series of the flanges 56, 57 and 58 which overlie and encircle the upper and lower lips 64 and 62 respectively formed in the sleeve 60. The bracing flange further aids in resistance to breakage of the pump assembly should the fan device 10 be dropped or fall, thereby rendering the device less likely to be damaged upon impact.

It is further observed that the assembly of the various parts to form the portable misting fan device 10 of the present invention eliminates the need to use adhesives, sonic welding, or other such more expensive techniques for assembling the parts and locking the same in position to form the completed fan device 10. Hence, the present invention provides a economically efficient break resistant joint which can be employed for assembling any device together which is formed of upper and lower portions where it is intended to reduce the risk of breaking the device upon falling or upon impact on a hard surface. The present construction, formed by the various parts and elements as described, is particularly adaptable to portable misting fan devices which are generally used in connection with a variety of activities, especially sports activities, where the risk of the device falling or impacting a hard surface is enhanced.

While there has been described what is a present considered to be the preferred embodiment of the invention, it will be understood that various modifications and variations may be made therein without departing from the true spirit and scope of the invention as embodied in the accompanying claims.

The invention claimed is:

1. A misting fan device of the type formed by an upper body portion accommodating a motorized fan assembly and a spray misting assembly, and a lower body portion accommodating a fluid reservoir and a fill port for the fluid reservoir, the improvement comprising in combination, the lower body portion having an upwardly contoured configuration terminating in an upper neck portion having a non-circular configuration and a relatively flat top wall, an aperture formed in said top wall of said neck portion, said aperture providing an access port for the spray misting assembly to establish fluid communication as between the fluid reservoir and the spray misting assembly, said upper body portion formed by a first half body portion and a second half body portion, each of said first and second half body portions terminating in a first collar body and a second collar body respectively, one of said neck portion and said first collar body and said second collar bodies having a least one elongate groove formed therein, and the other of said neck portion and first and second collar bodies having at least one rail formed therein, said first and second collar bodies being formed and contoured to overlie and capture said neck portion therebetween and said rail being slidedly engaged within said groove when said first and second half body portions are assembled onto said neck portion to form said upper body portion, and lock means for locking said first and second body portions together when assembled on said neck portion thereby to form a break resistant joint as between said lower body portion and said upper body portion when said misting fan device is assembled.

2. The misting fan device as set forth in claim 1 above, wherein said neck portion assumes a substantially square configuration bounded by opposed side walls and a relatively flat top wall, and said first and second half body portions are provided with first and second collar bodies respectively which are contoured and configured to overlie and capture said neck portion therebetween when said first half and second half body portions are assembled onto said neck portion.

3. The misting fan device as set forth in claim 1 above, wherein said first half body portion comprises a front half body portion and said second half body portion comprises a rear half body portion.

4. The misting fan device as set forth in claim 2 above, wherein said elongate groove is formed in at least one of said side walls of said neck portion and at least one of said first and second collar bodies has a rail formed therein, said rail being sized and configured to engage within said groove when said first and second half body portions are assembled on said neck portion.

5. The misting fan device as set forth in claim 4 above, wherein said neck portion is provided with a groove formed in each of the opposed side walls thereof, and each of said first and second collar bodies is provided with a pair of opposed rails formed therein, said rails being sized and configured to engage within the corresponding grooves of said neck portion when said first half and second half body portions are assembled on said neck portion.

6. The misting fan device as set forth in claim 1 above, wherein said aperture in said neck portion is adapted to accept a sleeve fitted therein, said sleeve having a lower end press fitted within said aperture and an upper end extending upwardly from said aperture, said upper end having at least one lower lip formed thereon and extending laterally outwardly for a distance, and at least one of said first and second collar bodies having a flange formed thereon and extending inwardly therefrom, said flange being sized and positioned such that said flange will overlie said lower lip when said first and second half body portions are assembled on said neck portion thereby to further secure the joint between the upper and lower body portions when assembled together.

7. The misting fan device as set forth in claim 6 above, wherein each of said first and second collar bodies has a flange formed thereon and extending inwardly therefrom each of said flanges being sized and positioned to overlie said lower lip when said first and second half body portions are assembled on said neck portion.

8. The misting fan device as set forth in claim 6 above, wherein said sleeve further includes an upper lip formed on said sleeve, said upper lip being spaced from said lower lip a short distance, and at least one of said first and second collar bodies has a securement flange formed thereon and extending inwardly a distance, said securement flange being spaced and positioned to overlie said upper lip when said first and second half body portions are assembled on said neck portion.

9. The misting fan device as set forth in claim 8 above, wherein each of said first and second collar bodies is provided with a securement flange formed thereon and extending inwardly a distance, said securement flanges each being spaced and positioned to overlie said upper lip when said first and second half body portions are assembled on said neck portion.

10. The misting fan device as set forth in claim 1 above, wherein one of said first and second collar bodies includes a stabilizing flange formed thereon and extending inwardly a distance, said stabilizing flange being spaced and positioned to matingly engage said sleeve when said first and second half body portions are assembled on said neck portion.

11. The misting fan device as set forth in claim 1 above, wherein said lower body portion is configured to have a support ledge formed immediately below and surrounding said neck portion, said support ledge forming a support surface for supporting said first and second collar bodies thereon when said first and second half body portions are assembled on said neck portion.

12. The misting fan device as set forth in claim 5 above, wherein each of said pair of opposed rails are centrally cored and provided with internal threads, and one of said first and second collar bodies is provided with access openings, said access openings being in horizontal alignment with said central cores, and said lock means comprises screws which may be inserted through said access openings and screw-threaded into said central cores to lockingly engage said first and second half body portions together when assembled on said neck portion.

13. A misting fan device of the type formed by an upper body portion accommodating a motorized fan assembly and a spray misting assembly, and a lower body portion accommodating a fluid reservoir and a fill port for the fluid reservoir, the improvement comprising in combination, the lower body portion having an upwardly contoured configuration terminating in an upper neck portion bounded by a relatively flat top wall and opposed side walls which are substantially parallel in configuration, said upper neck portion having an aperture formed in said top and said neck portion further provided with a pair of opposed parallel elongate grooves formed therein and extending along said opposed side walls, said aperture providing an access port for said spray misting assembly to establish fluid communication as between said fluid reservoir and said spray misting assembly, said upper body portion formed by a first front half body and a second rear half body, each of said first and second front and rear half bodies respectively terminating in a front collar body and rear collar body respectively, each of said front and rear collar bodies provided with a pair of opposed rails formed integrally therein, said front and rear collar bodies being formed and contoured to overlie and capture said neck portion therebetween and said rails being slidelingly engaged within said respective parallel grooves in said neck portion when said first front half and second rear half body portions are assembled onto said neck portion to form said upper body portion, and lock means for locking said first front half body to said second rear half body portion together, thereby to form a break resistant joint as between said upper body portion and said lower body portion when said misting fan device is assembled.

14. The misting fan device as set forth in claim 13 above, wherein said aperture is adapted to accept a sleeve fitted therein, said sleeve having a lower end press fitted within said aperture and an upper end extending upwardly from said aperture, said upper end having at least one lower lip formed on said sleeve and extending laterally outwardly for a distance, each of said front and rear collar bodies having an interior flange formed therein and extending inwardly for a distance, each of said flanges being spaced and positioned such that said flanges will surround said sleeve and overlie said lower lip when said first front half and second rear half body portions are assembled on said neck portion thereby to further secure the joint between said upper body and lower body portions when the misting fan device is assembled.

15. The misting fan device as set forth in claim 14 above, wherein said sleeve further includes an upper lip formed on said sleeve, said upper lip being spaced from said lower lip a short distance, and at least one of said front and rear collar bodies has a securement flange formed thereon and extending inwardly a distance, said securement flange being spaced and positioned such that said securement flange will overlie said upper lip when said first front half and second rear half body portions are assembled on said neck portion.

16. The misting fan device as set forth in claim 14 above, wherein one of said front and rear collar bodies includes a stabilizing flange formed thereon and extending inwardly a distance, said stabilizing flange being spaced and positioned to matingly engage said sleeve when said first and second front and rear half bodies are assembled on said neck portion.

17. The misting fan device as set forth in claim 13 above, wherein said lower body portion is configured to have a support ledge formed immediately below and surrounding said neck portion, said support ledge forming a support surface for supporting said front and rear collar bodies thereon when said first and second front and rear half bodies are assembled on said neck portion.

18. The misting fan device as set forth in claim 13 above, wherein each of said pair of opposed rails is provided with a central core, each of the cores provided with internal threads, and one of said front and rear collar bodies is provided with access openings, said access openings being in horizontal alignment with said central cores, and said lock means comprises screws which may be inserted through said access openings and screw-threaded into said central cores to lockingly engage said first and second front and rear body halves together when assembled on said neck portion.

* * * * *